United States Patent [19]

Stirbis

[11] Patent Number: 4,491,068

[45] Date of Patent: Jan. 1, 1985

[54] PRINT CYLINDER ASSEMBLY AND MOUNTING AND TIGHTENING APPARATUS THEREFOR

[75] Inventor: James S. Stirbis, Littleton, Colo.

[73] Assignee: Adolph Coors Company, Golden, Colo.

[21] Appl. No.: 536,164

[22] Filed: Sep. 26, 1983

[51] Int. Cl.[3] ..... B41F 17/22

[52] U.S. Cl. ..... 101/40; 101/375

[58] Field of Search ..... 101/40, 415.1, 216, 101/219, 217, 375; 100/168; 29/110

[56] References Cited

U.S. PATENT DOCUMENTS

| | | | |
|---|---|---|---|
| 2,796,164 | 6/1957 | Makogi | 101/40 X |
| 3,973,496 | 8/1976 | Cerny et al. | 101/415.1 |
| 4,037,530 | 7/1977 | Sirvet | 101/40 |

*Primary Examiner*—Clifford D. Crowder

*Attorney, Agent, or Firm*—Klaas & Law

[57] ABSTRACT

A continuous can printing machine for decorating can bodies having a printing cylinder assembly including multiple printing plates of predetermined size accurately mounted on a peripheral surface of a cylinder having a circumference substantially greater than the circumference of a can to be printed and being quickly and accurately mountable and removable from a drive shaft by use of an eccentric tightening apparatus.

15 Claims, 8 Drawing Figures

PRINT CYLINDER ASSEMBLY AND MOUNTING AND TIGHTENING APPARATUS THEREFOR

BACKGROUND OF THE INVENTION

The present invention relates to package decorating apparatus and, more particularly, to high speed can printing machines having printing cylinder assemblies comprising drive shaft mounted printing cylinders with attached printing plates which are used to transfer ink images to a blanket means which in turn transfers the ink images to cans.

Can printing (decorating) machines, especially high speed continuous can printing machines, operate by the impingement of a rotating, image-carrying blanket wheel and an oppositely rotating can carrying mandrel wheel. The blanket wheel comprises a blanket which is at least as wide as the length of the cans being printed. The blanket carries a series of wet ink images circumferentially spaced on its resilient periphery. The mandrel wheel carries a series of circumferentially spaced, rotatable shaft, or mandrel, assemblies, over which cans are fitted. The cans rotate on the mandrel wheel into registry and contact with the images and surface of the blanket wheel. Each mandrel generally includes structure for removing cans from or drawing cans onto the mandrel shaft.

The wet ink images carried by the blanket wheel are transferred thereto by one or more printing cylinder assemblies, each color of the ink image being transferred to the blanket wheel by a separate assembly.

Each printing cylinder assembly includes a rigid, high strength printing cylinder, mounted on a central cylinder drive shaft which is positioned in parallel alignment with the blanket wheel axis of rotation. The surface of the printing cylinder is smooth, generally highly polished metal. In most existing can printing machines a printing plate having a width substantially equal to the axial length of the printing cylinder and having a length substantially equal to the circumference of the cylinder is attached about the circumference of the printing cylinder.

Printing plates of the type presently used in high speed can printing machines are generally laminates comprising an inner layer of high strength material such as steel which is positioned in contacting engagement with the exterior surface of the printing cylinder, and an outer layer generally comprises a non-metal material such as plastic which is bonded to the surface of the inner layer of material. The outer layer of the printing plate has a raised pattern portion having the same configuration as the image to be printed on a can. The pattern is provided by chemical etching or other methods which are well known in the art. The pattern portion is coated with ink by conventional inking apparatus such as ink rollers. The ink carried on the pattern is then transferred to the blanket wheel by rolling contact between the blanket wheel and the printing plate, thus producing an ink image on the blanket wheel having the mirror image configuration of the raised pattern portion of the printing plate. The image on the blanket wheel is transferred to a can to be printed by subsequent rolling contact of the can with the blanket wheel.

High speed decorating systems are described in Stirbis U.S. Pat. No. 4,267,771, issued May 19, 1981; Sirvet, U.S. Pat. No. 4,037,530, issued July 29, 1977; and McMillin et al U.S. Pat. No. 4,138,941, issued Feb. 13, 1979, all of which are hereby incorporated by reference.

In earlier machines, in the type of system described in Stirbis, U.S. Pat. No. 4,267,771, printing cylinders were provided having a circumference substantially equal to the circumference of a can to be printed plus the length of the space to be allowed between images on the blanket wheel.

As the operating speeds of can decorating machines have increased with newer technology, the rotational speeds of printing cylinders used thereon have increased proportionally and have become a source of problems because of inertial effects associated with rapid rotation. One method of dealing with such rotational speed-related problems has been to increase the circumference of the printing cylinder and to provide multiple image patterns on an associated printing plate rather than a single image pattern. For example a printing cylinder assembly having a circumference substantially equal to twice the circumference of a can to be printed plus twice the length of the space between images on the blanket wheel could be provided with two symmetrically spaced apart image patterns rather than one. Such a printing cylinder assembly would rotate at half the speed which would be required of a single image cylinder assembly operating at the same machine speed. However, it has been discovered that use of a larger diameter printing cylinder with a multiple image pattern printing plate, under certain conditions, introduces mounting accuracy problems between the printing plate and printing cylinder. For example, in printing cans such as beverage cans having a diameter of substantially 2.5 inches, it has been discovered that for reasons which are probably related to surface friction between the printing cylinder and the double image printing plate, accurate mounting of a double image printing plate was impossible. Any attempted mounting of the double image printing plate causes deformation of the plate placing the images thereon slightly out of phase or causing image distortion in at least one of the image patterns. Surface lubrication of the printing cylinder, surprisingly, does not alter these results.

It has also been found that when printing cylinders of sufficient size to carry two can-image patterns on the surface thereof are used, accurate mounting of the cylinder on a drive shaft becomes problematic. Due to the larger diameter of the cylinder, any inaccuracy produced by inexact tolerances between the cylinder bore and the shaft received therein are magnified and tend to produce "wobble" resulting in misregistry and deformation of the ink patterns printed on the blanket wheel surface. However, if extremely accurate tolerances with minimal clearances between the shaft and cylinder bore are provided, it becomes very difficult and time consuming to mount or remove the cylinder from the shaft. Since cylinder plates wear and must frequently be replaced, it is necessary to remove and remount the cylinder periodically. Thus, close tolerance mounting has, in the past, not been considered practical.

It would be desirable to produce a can decorating machine capable of operation at high speeds without encountering printing cylinder assembly problems related to rapid rotational speeds. It would also be desirable to produce such a can decorating machine which does not cause distortion of the printed images when using printing cylinder assemblies having multiple image patterns. It would also be desirable to provide apparatus for quickly and accurately mounting a printing cylinder on an associated drive shaft.

SUMMARY OF THE INVENTION

The present invention includes a continuous can printing machine for decorating can bodies of a preselected circumference comprising: infeed means for feeding can bodies to be printed into the can printing machine; pocket wheel means for radially receiving can bodies from the infeed means; mandrel wheel means positioned in proximate, coaxial relationship with the pocket wheel means for axially receiving can bodies from the pocket wheel means; mandrel means operably mounted on the mandrel wheel means for receiving can bodies thereon in rotatable relationship thereon, the mandrel arms being pivotally displaceable relative the mandrel wheel means for urging the can bodies into rotating contact with the blanket belt means; blanket means for receiving ink images on a surface thereof and for transferring the ink images to can bodies carried on the mandrel arms and positioned in rotating contact with the blanket belt means; printing cylinder assembly means for printing ink images onto the blanket means; and ink supply means for coating the printing cylinder means with ink; the printing cylinder assembly means comprising rotatable cylinder means having a smooth cylindrical exterior surface with a circumference substantially equal to an integer multiple of the sum of the circumference of a can to be printed and the length of a space provided between a pair of the ink images printed on the blanket means, the integer multiple defining a plate number; a plurality of printing plate means, each comprising an inwardly position mounting layer having a mounting surface positionable in substantially continuous contacting engagement with the exterior surface of the cylinder means and having an outwardly positioned printing layer having an image pattern portion thereon for carrying ink and for printing ink images on the blanket means; the plurality of printing plate means being equal in number to the plate number; and printing plate attachment means for attaching the printing plate means to the cylinder means in fixed, selectively detachable relationship therewith.

The printing cylinder assembly may have a mounting and tightening apparatus associated with it, and may thus include cylinder means comprising a generally cylindrical wall portions and a first and second generally circular, axially opposite, end wall portion symmetrically positioned about a central longitudinal axis; shaft bore means for receiving a drive shaft means provided in the first and second end wall portions in coaxial alignment with the printing cylinder central longitudinal axis, the shaft bore means circumference comprising at least one relatively large radius portion and at least one relatively small radius portion; drive shaft means for rotating the printing cylinder means received within the shaft bore means having a generally cylindrical configuration with a radius substantially equal to the radius of the relatively small radius portion of the shaft bore means; drive shaft tightening means for urging the drive shaft means into fixed contacting engagement with the relatively small radius portion of the shaft bore means, whereby the drive shaft means is positioned in coaxial relationship with the printing cylinder means.

DESCRIPTION OF THE PREFERRED EMBODIMENT IN GENERAL

Figure 1:
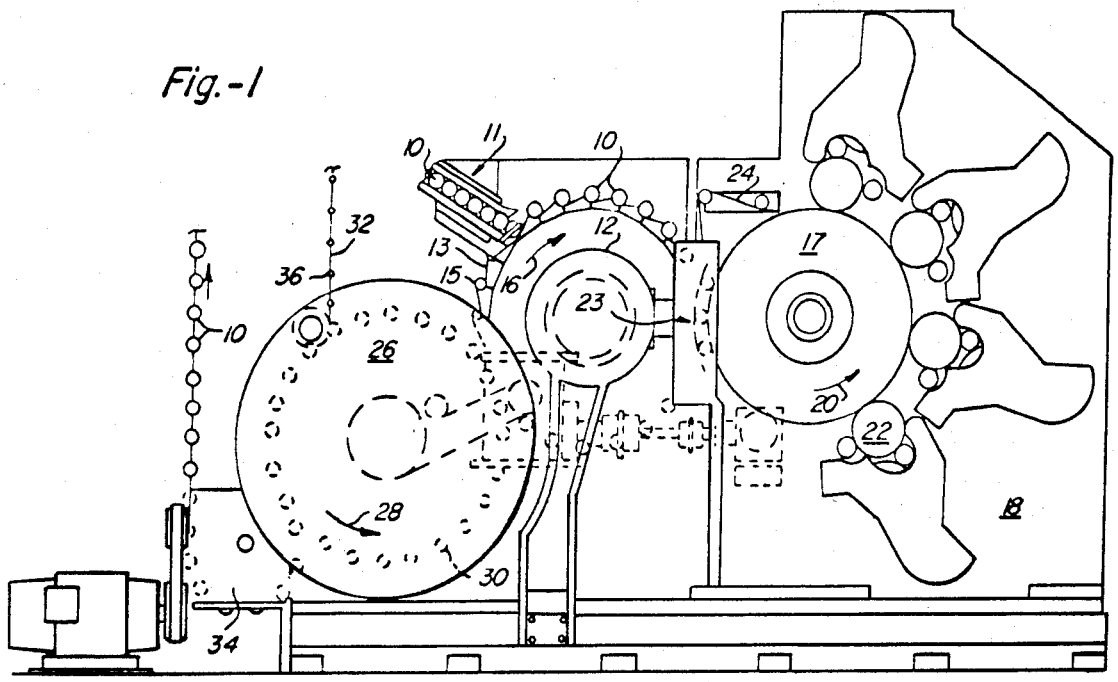
FIG. 1 is a schematic illustration of a high-speed continuous can decorating machine.
Figure 2:
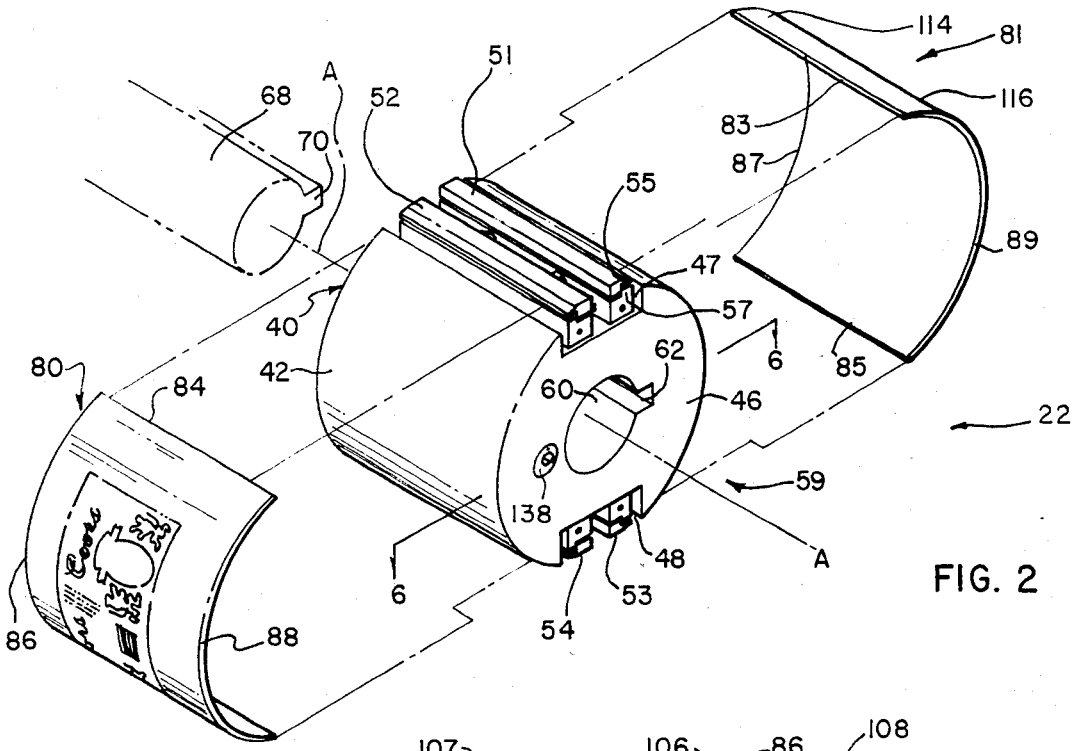
FIG. 2 is an exploded perspective view of a print cylinder assembly.
Figure 3:
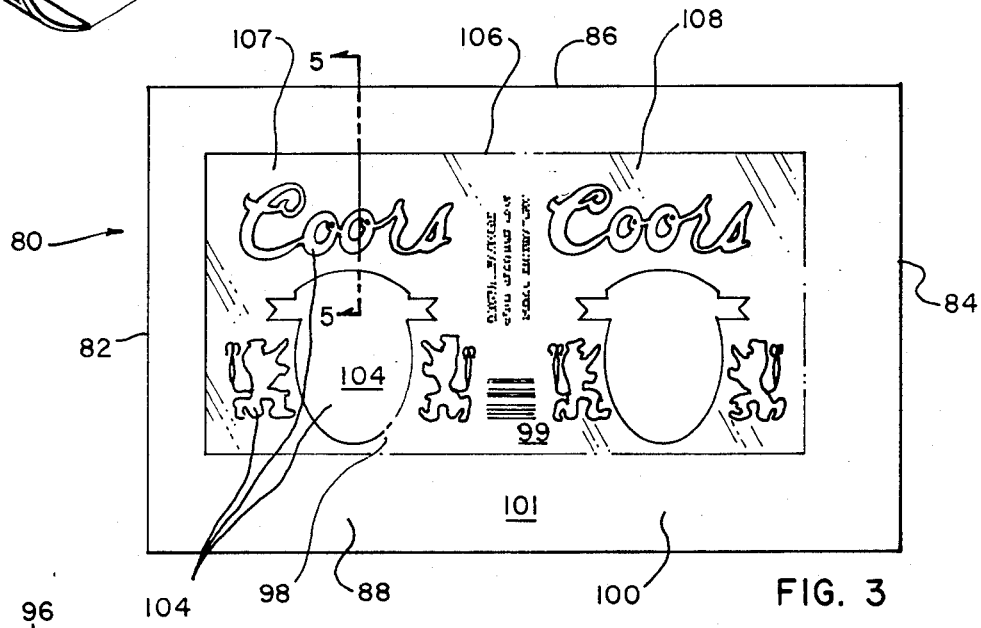
FIG. 3 is a plan view of a printing plate.

Referring now to FIG. 1, a conventional high speed continuous can printer is shown wherein cans 10 are fed through an infeed chute 11 to a pocket wheel 12 comprising a plurality of pockets 13, each having a concave semi-cylindrical surface in which cans rest and are retained by gravity. Behind the pocket wheel 12, in coaxial relationship therewith, is a mandrel wheel assembly bearing a plurality of mandrel assemblies 15 which approximate the internal diameter of the cans 10 and which are aligned with the pockets 13 of the pocket wheel 12 so that cans may be slid from each pocket onto a corresponding mandrel by angled fingers and a burst of compressed air. Cans are held against the mandrel sleeves by vacuum applied through the mandrel. Each mandrel and can thereon rotates continuously with the mandrel wheel assembly in a generally circular path of travel in the direction of arrow 16 to the vicinity of a printing blanket wheel 17 mounted in radial opposition to the mandrel wheel on a machine stand 18. The blanket wheel 17 is driven in the direction of arrow 20 opposite to the direction of arrow 16 and carries on its periphery a smooth, segmented rubber printing blanket bearing wet reverse ink images to be transferred to the cans. The width of the printing blanket corresponds to the length of the cans. The ink images are placed on the blanket wheel by printing cylinder assemblies 22 mounted on the machine stand 18, there being one printing cylinder assembly and associated ink supply rolls for each color contained in the ink image. In the vicinity of the blanket wheel, the mandrels 15 depart from their circular path of travel and move in a path defined by a cam track in a concave path shown in exaggerated form at 23, which corresponds to the circumference of the printing blanket. The printing operation involves contact between the rotating can and a segment of the printing blanket during mandrel movement along the concave portion 23 of the mandrel assembly track.

During the printing operation, a can may be dented or for some other reason not properly seated on a mandrel sleeve. In order to prevent contamination of a bare mandrel sleeve with ink from the printing blanket, a "skip print" mechanism is provided to prevent contact of a bare mandrel sleeve with the printing blanket such as described in U.S. Pat. No. 4,037,530.

After printing, the cans 10 again follow a circular path of travel at the periphery of the mandrel wheel to a transfer mechanism such as a continuously rotatable transfer wheel 26 mounted for rotation in the direction of arrow 28 parallel to the mandrel wheel and comprising a peripheral array of transfer devices, such as suction cups 30 extending axially towards the mandrels and rotating in cooperation therewith to pass oppositely of the mandrels. The transfer devices 30 are carried on the transfer wheel 26 to an output conveyor chain 32 powered by a chain drive 34 and comprising a plurality of pins 36. The pins 36 extend from the chain towards the cans on the transfer wheel and are spaced and arranged so that each pin enters a can on the transfer wheel and supports the can upon removal of suction from the suction cups 30. The cans 10 on the pins 36 move away from the suction cups and the transfer wheel and are carried to a drying oven for further handling.

Printing Cylinder

As illustrated by FIG. 2, 6, 7 and 8, the printing cylinder assembly 22 of the present invention comprises a printing cylinder 40 having a generally cylindrical wall portion 41 with an outer generally cylindrical surface 42 and opposite cylinder end walls 43, 45 with generally circular end wall surfaces 44, 46. The cylinder outer cylindrical surface 42 in a preferred embodiment is a smooth metal surface such as polished steel designed to minimize sliding friction between the printing cylinder 40 and printing plates 80, 81 attached thereto as described in further detail hereinafter. The outer surface of the printing cylinder 40 defines generally rectangular, axially extending, channel portions 47, 48 positioned in diametrically opposed relationship. In a typical application for printing cans having a diameter on the order of 2.5 inches, a typical cylinder may have a diameter of 8.0 inches and may have channel portions having a channel width of 3.375 inches and having a depth on the order of 1.0 inch. Conventional adjustable plate clamping apparatus 51, 52, 53, 54 are positioned within the channel portions 47, 48 and are adjustable axially, radially and circumferentially by conventional adjustment means such as screw apparatus (not shown). The clamping apparatus may be mounted to the cylinder as through clamp attachment holes 56, 58. End surfaces of the cylinder plate means 80, 81 are received between opposed clamping surfaces 55, 57 of each clamping apparatus to hold the cylinder plate means in fixed relationship relative the circumferential surface 42 of the cylinder means 40. The adjustable plate clamping apparatus 51–54 are thereafter adjusted as necessary to bring predetermined points (not shown) on the plate means 80, 81 into registry with predetermined points (not shown) on the peripheral edge of the cylinder in the same manner as when conventionally mounting a single plate about a cylinder.

Figure 6:
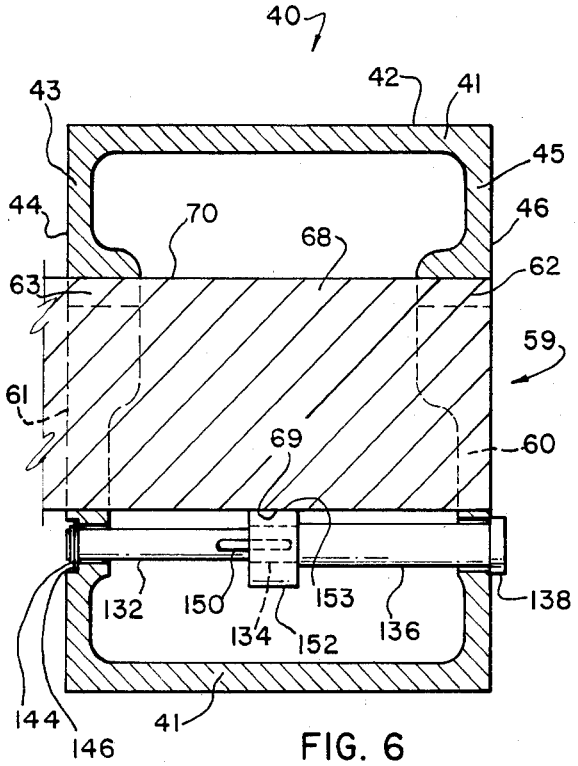
FIG. 6 is a partial cross-sectional view of the printing cylinder of the printing cylinder assembly in FIG. 2.
Figure 7:
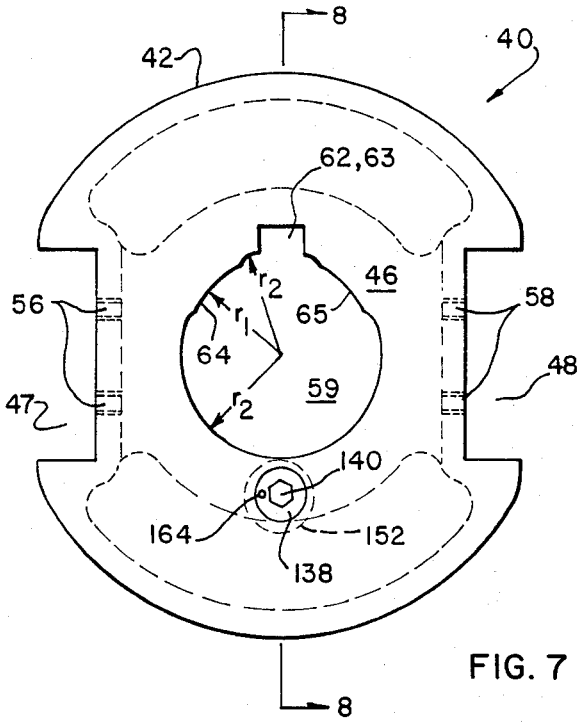
FIG. 7 is an end elevation view of the printing cylinder of FIGS. 2 and 6.
Figure 8:
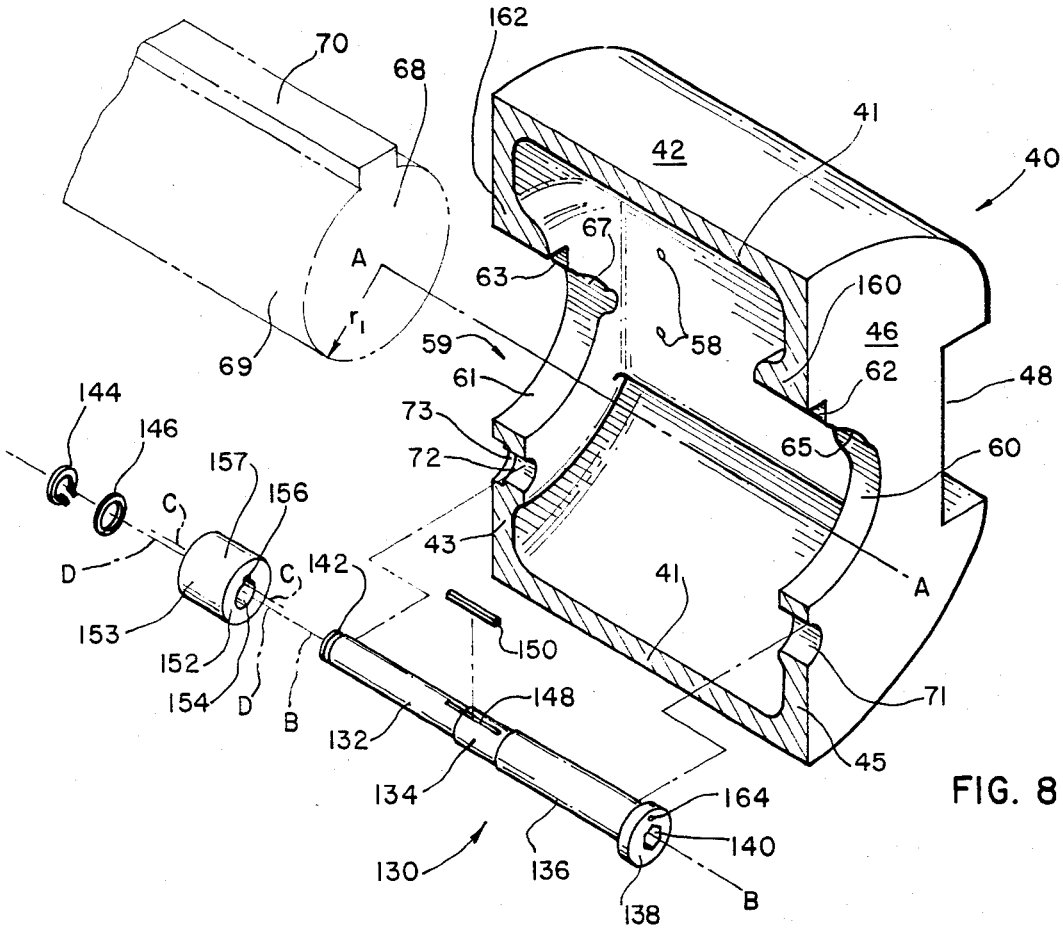
FIG. 8 is an exploded cut-away perspective view of the printing cylinder of FIGS. 2, 6, 7, and 8.

As illustrated by FIGS. 2, 6, 7, and 8, cylinder means 40 has a centrally positioned, axially extending, relatively large diameter bore 59 therein having a central axis which is coaxial with the cylinder central longitudinal axis and indicated as AA. The bore 59 comprises a first end portion 60 positioned in end wall 45 and a second end portion 61 positioned in end wall 43 in coaxial and mirror image relationship with first end wall bore portion 60. The central portion of the cylinder lying between the two end walls is generally hollow, as best illustrated by FIGS. 6 and 8. Each bore portion 60, 61 comprises a slot portion 62, 63 therein having a generally rectangular configuration and extending radially outwardly from the circular circumference portions of the bore. The circumference of each bore portion 60, 61 comprises two smaller radius portions. These are indicated as 64, 65 in bore 60, FIG. 7. Only one small radius portion 67 is shown for bore 61 by FIG. 8, however, the two small radius portions in bore 61 are identical to portions 64 and 65 in bore 60. The smaller radius portions are typically centered at about 45° on either side of a diameter extending through the center of an associated slot portion 62, 63 and typically extend a total arcuate distance of approximately 30° to 45°. The remaining circumference of each bore 60, 61 comprises a slightly larger radius. The relatively small radius portions 64, 65, etc. have a radius $r_1$ identical to that of a shaft 68 to be positioned therein. The larger radius portion has a radius $r_2$ slightly larger to accommodate insertion and removal of shaft 68 therefrom. In a typical embodiment used to print 2½ inch diameter cans, radius $r_2$ is 1.625 inches and radius $r_1$ is 1.650 inches.

Drive shaft means 68 received within bores 61, 60 comprises a generally cylindrical outer surface 69 having a radius $r_1$ equal to that of bore smaller radius portions 64, 65, 67, etc. and having a key portion 70 adapted to be accepted within slot portions 62, 63. Two substantially smaller radius circular bores 71, 72 in cylinder walls 43, 45 are positioned in coaxial alignment in offset parallel relationship with axis AA in generally diametrically opposite relationship with slot portions 62, 63 of bore portions 60, 61. A slightly larger radius counter bore 73 is provided in axially adjacent relationship with bore 72.

A drive shaft tightening means is provided which may comprise a tightening assembly including tightening shaft 130 adapted to be received within the bores 71, 72, 73. The tightening shaft 130 may have a length of 7.25 inches comprising a small radius portion 132, e.g. 0.499 inch diameter, an intermediate radius portion 134, e.g. 0.510 inch diameter, and a large radius portion 136, e.g. 0.624 inch diameter. The tightening shaft has an enlarged end 138, e.g. 0.88 inch diameter, having a polygonal hole 140 in the end thereof adapted to receive an Alan wrench or the like for rotating the tightening shaft 130. An annular groove 142 is positioned at the end opposite that of the enlarged portion 138. The annular groove 142 is adapted to accept a snap ring 144 having an outer diameter sufficiently large to retain an annular washer means 146. The tightening shaft 130 may thus be retained in axially fixed relationship within the bores 71, 72, 73 as illustrated in FIG. 6. The tightening shaft 130 also comprises a rectangular cross-sectioned axially extending channel portion 148 adapted to fixedly accept rectangular cross-section key 150. Key 150 extends from smaller radius portion 132 into intermediate radius portion 134.

A cylindrical sleeve 152 constructed from conventional bearing material such as brass or oil impregnated brass, commonly known as oilite, comprises an eccentrically positioned bore 154 having an axis DD which is parallel and off-set from the sleeve central longitudinal axis CC. The bore comprises a slot portion 156 having a cross-section adapted to accept key portion 150. The diameter of eccentrically positioned bore 154 is slightly larger than the diameter of tightening shaft small radius portion 132 and slightly smaller than the diameter of large radius portion 136 whereby it may be tightly accepted on intermediate radius portion 134 by press fitting. The outer edges of the bore 154 may be slightly rounded at the end which is initially inserted onto the shaft to facilitate mating with key 150 and intermediate radius portion 134.

The tightening shaft and sleeve are mounted within the cylinder means 40 by first partial inserting shaft 130 through bore 71, then by affixing of key portion 150 within slot 148 by necessary manual manipulation through bores 60 or 61. Next, sleeve 152 is inserted through bore 61 and placed on the end of shaft 130 and urged axially therealong into press-fit relationship with taper portion 134. The tightening shaft 130 is thereafter extended through bores 72 and 73 and affixed therewithin by attachment of washer 146 and snap ring 144. Thus assembled, the sleeve has a high side 157 and an opposite low side. In a preferred 10 embodiment wherein the cylinder is used to print 2½ inch diameter cans, the sleeve comprises a diameter of approximately 1.125 inches and has a bore axis which is offset approximately 0.020 inches from the sleeve centerline. The tightening shaft 130 central axis BB is positioned at a distance from the drive shaft central axis AA such that sleeve outer surface 153 is in touching or near touching engagement with main shaft cylindrical outer surface 69 when the high side 157 of sleeve 152 is positioned in non-engaging, diametrically opposite relationship with the contact surface on main shaft 68, when i.e. the low side 159 is immediately adjacent shaft surface 69. A marker such as small bore 164 may be provided on an exterior surface of enlarged portion 138 to indicate the position of the high side 157 of the eccentric sleeve 152. Main shaft 68 may be locked into position against bore 60, 61, small radius portions 64, 65, 67, etc. by rotation of the high side 157 of sleeve 152 into contacting engagement with the surface 69 of shaft 68. This rotation may be provided as by use of an Allen wrench within bore portion 140. In the preferred embodiment, tightening shaft 130 is constructed of a material such as 4140 alloy steel which flexes slightly as the eccentric is rotated into tightening relationship with shaft 68. The slight elastic bowing produced in shaft 130 produces an elastic restoration force therein, which tends to urge sleeve 152 toward shaft 68. The coefficion of friction between the sleeve surface 153 and shaft surface 69 is sufficient to create a friction force which resists rotation and prevents the sleeve 152 from working loose from engagement with shaft 68 when tightening shaft 130 is thus flexed. A less flexible shaft 130 might also be employed in slightly closer relationship to the drive shaft 68. The tightening shaft 130 thus accurately holds the drive shaft 68 and cylinder 40 in proper relationship, allowing a securing device such as an end cap (not shown) to be clamped to the cylinder by conventional methods well known in the art.

In order to symmetrically balance the weight added by tightening shaft 130 and sleeve 152 and also to provide an extended small radius contact area for securing shaft 68 to the cylinder means 40, the wall thickness in a semicircular band portion 160, 165 of each end wall 43, 45 is extended axially inwardly a small distance. For example, in a typical print cylinder having a length of about 7.0 inches the wall thickness in a semi-circular areas adjacent bore portion 60 and containing key slot 62, and in a semi-circular area adjacent bore portion 61 and containing key slot 63 is about 1¼ inches while other portions of the end walls 43, 45 have a thickness of about ⅜ inches. Cylindrical wall 41 in such an embodiment would also typically have a thickness of about ⅜ inch.

Thus, the cylinder means is provided with a means for being accurately mounted on a shaft to provide accurate registry of ink images in a can printing operation. The apparatus used for the mounting allows relatively quick mounting or removal of the cylinder from the shaft with minimal manual manipulation.

Printing Plates

Figure 5:
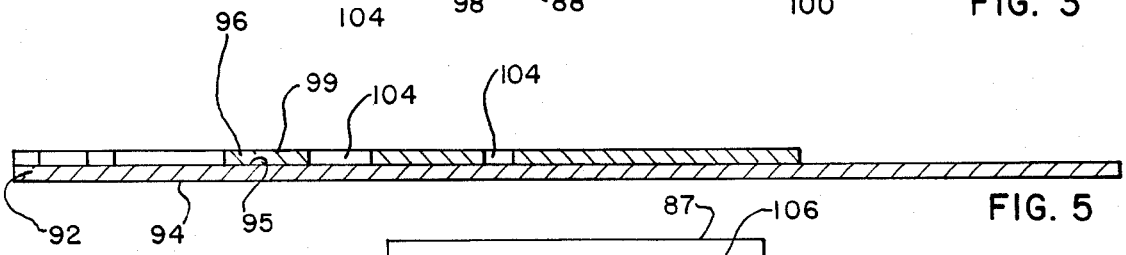
FIG. 5 is a cross-sectional view of a portion of the printing plate of FIG. 3.
Figure 4:
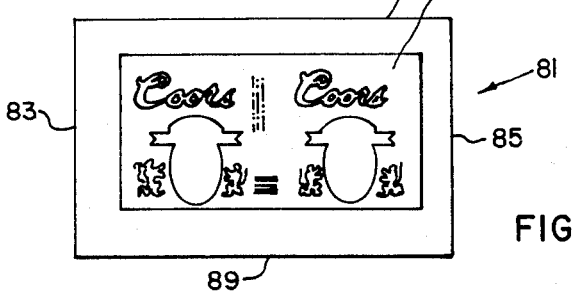
FIG. 4 is a plan view of another printing plate.

As illustrated in FIGS. 2-5, printing plates 80, 81 have identical rectangular shapes with left edges 82, 83, right edges 84, 85, top edges 86, 87, and bottom edges 88, 89, respectively. Each printing plate, as illustrated in FIG. 5, has a flat inner layer 92 which is constructed of a high strength material. In a preferred embodiment, layer 92 is a steel plate having a thickness of substantially 0.016 inches. The inner layer has a generally planar exterior surface 94 which is deformed into a partial cylinder configuration when the plate is mounted on the printing cylinder 40. The inner layer exterior surface 94, like the printing cylinder exterior surface 42 which it contacts, is smooth to reduce friction between the printing cylinder 40 and the printing plates 80, 81. An outer layer 96 which may have a thickness substantially equal to that of the inner layer, is provided in fixed relationship with the interior surface 95 of the inner layer 92 by conventional bonding means well known in the art. The material from which the outer layer 96 is constructed is typically a photopolymer plastic such as sold by the DuPont Chemical Company under the trademark Dycryl. The outer layer 96 comprises smooth exterior surface 99 and has recessed areas 104 therein formed by chemical etching which extend substantially to the inner layer interior surface 95. The thickness of the various plate layers 92, 96 and the material composition thereof may be essentially the same as that used in prior art devices utilizing a single plate rather than multiple plates. In the embodiment shown, the length, i.e. the dimension between left 82, 83 and right 84, 85 side edges of each of the two plates 80, 81 is substantially less than half the length of a conventional single plate having two image patterns thereon. For example, when printing can bodies having a diameter of about 2.5 inches, a single plate with two image patterns would typically have a length of about 26 inches, whereas one of the plates of the present invention may be about 12 inches in length. (As used herein, "image pattern" refers to a portion of outer layer 96 associated with the image printed on a single can such as indicated generally by the numeral 106. The image pattern length is equal to the circumference of the can. Such an image often has bilateral symmetry, having left and right portions 107, 108 of substantially identical configurations which produce identical image portions that are printed on the "front" and "back", respectively, of a can.) The circumference of the printing cylinder 40, in the preferred embodiment, is substantially larger than twice the circumference of a can to be printed to allow for spacing between the images printed onto the blanket wheel. The space between images printed on the blanket wheel, and thus the circumferential distance between two image patterns provided on a printing cylinder by the two plates 80, 81, may be on the order of 6 inches when printing cans having a circumference of about 8 inches (i.e. a can diameter of about 2.5 inches). Thus, each plate 80, 81 has a length slightly greater than the circumference of the can to be printed with the image pattern 106 having a length substantially identical to the circumference of the can to be printed. The maximum length of a plate which is permissible before the surface resistance phenomena causes distortion of the plate or prevents proper mounting thereof on an associated cylinder may be dependent upon a number of different physical parameters such as the surface friction coefficient between the plate inner surface and the outer surface of the cylinder, the modulus of elasticity of the plate high strength lower layer 92 and the circumference of the cylinder 40.

In the present preferred embodiment wherein two plates 80, 81 are used on each cylinder 40, the two plates cover substantially less than the entire surface 42 of the printing cylinder. In the preferred embodiment, when printing containers having a circumference of about 7½ inches, the length of each plate (i.e. the distance from edge 82 to edge 84 or edge 83 to edge 85) is substantially 11½ inches. It has been found that with a polished steel cylinder having a circumference of about 28 inches, that plates having a length of about 12 inches or less made from steel having a smooth exterior surface with a thickness of about 0.016 inches and a modulus of elasticity of about 30,000,000 lbs./sq. in. may be mounted on the printing cylinder without encountering sufficient surface resistance to cause distortion of the plates. Thus, when printing cans having circumferential dimensions on the order of 7½ inches, accurate registry may be obtained with a printing cylinder assembly 22 comprising two separate printing plates 80, 81, each having a single image pattern thereon, whereas accurate registry was impossible in the past with the use of a single plate having two separate images thereon.

It is contemplated that the inventive concepts herein described may be variously otherwise embodied and it is intended that the appended claims be construed to include alternative embodiments of the invention except insofar as limited by the prior art.

What is claimed is:

1. A continuous can printing machine for decorating can bodies of a preselected circumference comprising:

infeed means for feeding can bodies to be printed into the can printing machine;

pocket wheel means for radially receiving can bodies from said infeed means;

mandrel wheel means positioned in proximate, coaxial relationship with said pocket wheel means for axially receivng can bodies from said pocket wheel means;

mandrel means operably mounted on said mandrel wheel means for receiving can bodies thereon in rotatable relationship thereon, said mandrel arms being pivotally displaceable relative said mandrel wheel means for urging said can bodies into rotating contact with said blanket belt means;

blanket means for receiving ink images on a surface thereof and for transferring said ink images to can bodies carried on said mandrel arms and positioned in rotating contact with said blanket belt means;

printing cylinder assembly means for printing ink images onto said blanket means; and ink supply means for coating said printing cylinder means with ink;

said printing cylinder assembly means comprising rotatable cylinder means having smooth cylindrical exterior surface with a circumference substantially equal to an integer multiple of the sum of the circumference of a can to be printed and the length of a space provided between a pair of said ink images printed on said blanket means, said integer multiple defining a plate number;

a plurality of printing plate means, each comprising an inwardly positioned mounting layer having a mounting surface positionable in substantially continuous contacting engagement with the exterior surface of said cylinder means and having an outwardly positioned printing layer having an image pattern portion thereon for carrying ink and for printing ink images on said planket means;

said plurality of printing plate means being equal in number to said plate number; and printing plate attachment means for attaching said printing plate means to said cylinder means in fixed, selectively detachable relationship therewith;

wherein said can bodies to be printed comprise a circumference of substantially 7.5 inches, and wherein said cylinder means surface and the printing plate means mounting surface comprise a smooth metal surface, and wherein the modulus of elasticity of said printing plate mounting layer is substantially 30,000,000 pounds per square inch and wherein said thickness of said mounting layer is between 0.01 inches and 0.02 inches, and wherein the circumference of said cylinder means is substantially 28 inches, wherein said plurality of printing plates comprises two printing plates, and wherein each said printing plate means has a length less than 13 inches.

2. A printing cylinder and drive shaft mounting assembly comprising:

printing cylinder means for rotatably printing ink images on an associated adjacent printing surface, said printing cylinder means comprising a generally cylindrical wall portion and a first and second generally circular, axially opposite, end wall portions symmetrically positioned about a central longitudinal axis;

shaft bore means for receiving a drive shaft means provided in said first and second end wall portions in coaxial alignment with said printing cylinder central longitudinal axis, said shaft bore means circumference comprising at least one relatively large radius portion and at least one relatively small radius portion;

drive shaft means for rotating said printing cylinder means received within said shaft bore means having a generally cylindrical configuration with a radius substantially equal to the radius of said relatively small radius portion of said shaft bore means; and drive shaft tightening means for urging said drive shaft means into fixed contacting engagement with said relatively small radius portion of said shaft bore means, whereby said drive shaft means is positioned in coaxial relationship with said printing cylinder means.

3. The invention of claim 2 further comprising drive shaft radial locking means for retaining said drive shaft means in fixed engaging contact with said relatively small radius portion of said shaft bore means.

4. The invention of claim 3 further comprising key means for preventing rotational displacement of said shaft means relative said printing cylinder means.

5. The invention of claim 4 wherein said drive shaft tightening means comprises a tightening shaft assembly mounted in said cylinder means, said tightening shaft assembly having a central longitudinal axis of rotation positioned in substantially parallel non-coaxial alignment with said drive shaft means.

6. The invention of claim 5 wherein said tightening shaft assembly comprises:

eccentric means for engaging the surface of said drive shaft means during rotation of said tightening shaft assembly said eccentric means having a high side surface for urging said drive shaft means into tight contacting engagement with said relatively small radius portion of said drive shaft bore means and said eccentric means having a low side surface for being loosely engaged or disengaged from said drive shaft means for permitting relative axial sliding movement of said drive shaft means within said bore means.

7. The invention of claim 6 wherein said cylinder means comprises first and second tightening assembly mounting bores positioned in substantially coaxial alignment in said first and second end walls portions of said cylinder means, respectively.

8. The invention of claim, 7 wherein said tightening shaft assembly comprises:

a tightening shaft having a first end mounted in said first tightening assembly bore and having a second end mounted in said second tightening assembly bore; and eccentric sleeve means for receiving said tightening shaft therein, fixedly attached in selectively detachable relationship with said tightening shaft.

9. The invention of claim 7 wherein said eccentric sleeve means comprises a substantially cylindrical body having a central cylindrical axis said body having a bore therein having a central bore axis positioned in parallel non-coaxial relationship with said central cylindrical axis, said tightening shaft being received within said cylindrical body bore.

10. The invention of claim 9 wherein said tightening shaft means is elastically, radially deflectable by a radial force applied thereto by tightening of said eccentric sleeve against said drive shaft means whereby said tightening shaft exerts a continuous radial force through said eccentric sleeve means to said drive shaft means said radial force and the coefficient of friction between the surface of said eccentric sleeve and the surface of said drive shaft means being sufficient to hold said eccentric sleeve against said drive shaft means when said high side surface of said eccentric means is positioned in engaging contact with said drive shaft means.

11. The invention of claim 10 wherein said shaft tightening assembly comprises tightening shaft key means for preventing rotation of said tightening shaft relative said eccentric sleeve.

12. The invention of claim 11 wherein said eccentric sleeve means is mounted at substantially the axial center of said tightening shaft.

13. The invention of claim 12 wherein a mid portion of said tightening shaft comprises a portion of larger radius than an adjacent end portion of said tightening shaft for receiving said eccentric means in press fit relationship thereon.

14. The invention as in any of claims 2–13 wherein said drive shaft bore means comprises a first drive shaft bore in said first end wall portion of said cylinder means and a second drive shaft bore in said second end wall portion each of said drive shaft bores comprising two relatively small radius portions of the same radius positioned within an arc of less than 180°, said two relatively small radius portions of said first drive shaft bore being positioned in mirror image relationship with said two relatively small radius portions of said second drive shaft bore.

15. A printing cylinder assembly for use in a high-speed can body decoration machine for printing spaced-apart ink images on a blanket wheel, comprising:

rotatable cylinder means having a smooth cylindrical exterior surface with a circumference substantially equal to an integer multiple of the sum of the circumference of a can to be printed and the length of a space provided between a pair of the ink images printed on the blanket wheel, said integer multiple defining a plate number;

a plurality of printing plate means, each comprising an inwardly position mounting layer having a mounting surface positionable in substantially continuous contacting engagement with the exterior surface of said cylinder means and having an outwardly positioned printing layer having an image pattern portion thereon for carrying ink and for printing ink images on the blanket wheel; said plurality of printing plate means being equal in number to said plate number; and printing plate attachment means for attaching said printing plate means to said cylinder means in fixed, selectively detachable relationship therewith;

wherein said printing cylinder means comprises a generally cylindrical wall portion and a first and second generally circular, axially opposite, end wall portions symmetrically positioned about a central longitudinal axis;

shaft bore means for receiving a drive shaft means provided in said first and second end wall portions in coaxial alignment with said printing cylinder central longitudinal axis, said shaft bore means circumference comprising at least one relatively large radius portion and at least one relatively small radius portion;

drive shaft means for rotating said printing cylinder means received within said shaft bore means having a generally cylindrical configuration with a radius substantially equal to the radius of said relatively small radius portion of said shaft bore means; and drive shaft tightening means for urging said drive shaft means into fixed contacting engagement with said relatively small radius portion of said shaft bore means, whereby said drive shaft means is positioned in coaxial relationship with said printing cylinder means.

* * * * *